US005545974A

United States Patent [19]

Trainor et al.

[11] Patent Number: 5,545,974

[45] Date of Patent: Aug. 13, 1996

[54] VARIAMP OIL TEMPERATURE CONTROL

[75] Inventors: Jack Trainor, Wake Forest; Carl J. LaPlace, Raleigh, both of N.C.; James Harlow, Largo, Fla.

[73] Assignee: Siemens Energy & Automation, Inc., Alpharetta, Ga.

[21] Appl. No.: 314,972

[22] Filed: Sep. 29, 1994

(Under 37 CFR 1.47)

[51] Int. Cl.[6] ..... G05F 5/04

[52] U.S. Cl. ..... 323/340; 323/255

[58] Field of Search ..... 323/255, 256, 323/340, 341

[56] References Cited

U.S. PATENT DOCUMENTS 4,591,779 5/1986 Carpenter, Jr. et al. ..... 323/340

5,136,233 8/1992 Klinkenberg et al. ..... 323/340

5,450,002 9/1995 Dunk ..... 323/340

*Primary Examiner*—Peter S. Wong

*Assistant Examiner*—Y. J. Han

*Attorney, Agent, or Firm*—Donald M. Boles

[57] ABSTRACT

A voltage regulator controller of the types used with a multi-tap voltage regulator transformer having a plurality of tap positions for adjusting an output voltage in discrete tap position steps is provided with a number of control algorithms which are dynamically changed responsive to the measured oil temperature in the transformer. In one embodiment, the voltage regulator controller includes a memory having tap movement control code stored therein for controlling the tap positions in accordance with a plurality of tap position control algorithms, means for measuring the oil temperature of the voltage regulator transformer, means for monitoring the oil temperature within the transformer and, means for selecting one of the tap position control algorithms as being active as a function of the oil temperature.

8 Claims, 6 Drawing Sheets

VARIAMP OIL TEMPERATURE CONTROL

BACKGROUND OF THE INVENTION

This invention relates to voltage regulators and related control systems.

A step type voltage regulator is a device which is used to maintain a relatively constant voltage level in a power distribution system. Without such a regulator, the voltage level of the power distribution system could fluctuate significantly and cause damage to electrically powered equipment.

A step type voltage regulator can be thought of as having two parts: a transformer assembly and a controller. A conventional step type voltage regulator transformer assembly 102 and its associated controller 106 are shown in FIG. 1. The voltage regulator transformer assembly can be, for example, a Siemens JFR series. The windings and other internal components that form the transformer assembly 102 are mounted in an oil filled tank 108. A tap changing mechanism (not shown) is commonly sealed in a separate chamber in the tank 108.

The various electrical signals generated by the transformer are brought out to a terminal block 110, which is covered with a waterproof housing, and external bushings S, SL, L for access. An indicator 112 is provided so that the position of the tap as well as its minimum and maximum positions can be readily determined.

A cabinet 114 is secured to the tank to mount and protect the voltage regulator controller 106. The cabinet 114 includes a door (not shown) and is sealed in a manner sufficient to protect the voltage regulator controller 106 from the elements. Signals carried between the transformer or tap changing mechanism and the voltage regulator controller 106 are carried via an external conduit 116.

The tap changing mechanism is controlled by the voltage regulator controller 106 based on the controller's program code and programmed configuration parameters. In operation, high voltage signals generated by the transformer assembly 102 are scaled down for reading by the controller 106. These signals are used by the controller 106 to make tap change control decisions in accordance with the configuration parameters and to provide indications of various conditions to an operator.

SUMMARY OF THE INVENTION

In accordance with the present invention, a voltage regulator controller, of the type used with a multi-tap voltage regulator transformer, is provided with a number of control algorithms which are dynamically changed responsive to the measured oil temperature in the transformer. In one embodiment, the voltage regulator controller includes a memory having tap movement control code stored therein for controlling the tap positions in accordance with a plurality of tap position control algorithms, means for measuring-the oil temperature of the voltage regulator transformer, means for monitoring the oil temperature within the transformer and, means for selecting one of the tap position control algorithms as being active as a function of the oil temperature.

BRIEF DESCRIPTION OF THE DRAWINGS

Like reference numerals appearing in more than one figure represent like elements.

DETAILED DESCRIPTION OF THE PREFERRED EMBODIMENT

An embodiment of the present invention will now be described by reference to FIGS. 2 through 8.

Figure 3:
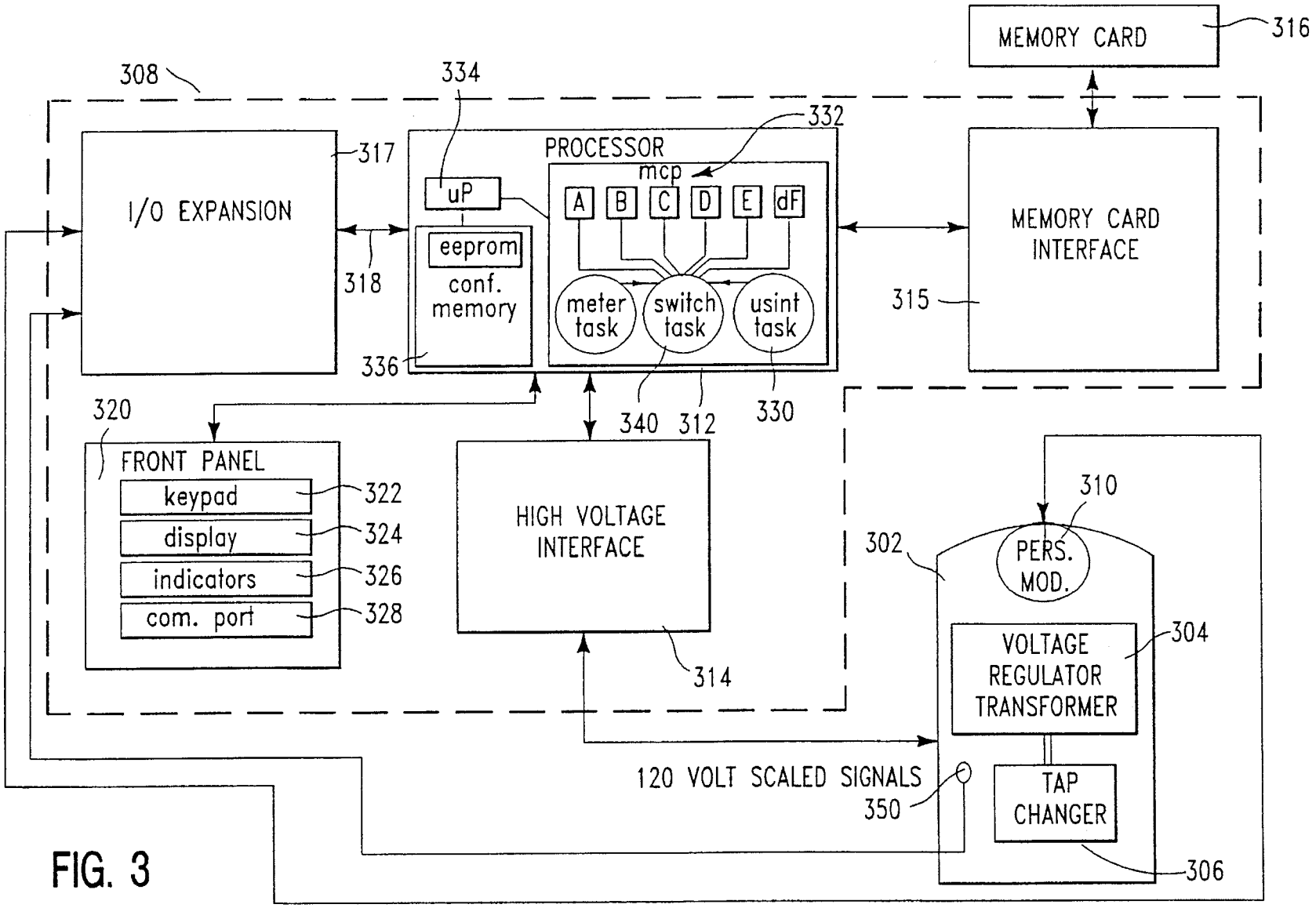
FIG. 3 is a block diagram of a voltage regulator controller in accordance with an embodiment of the present invention.

A step type voltage regulator and its associated controller according to an embodiment of the present invention are shown in FIG. 3. The voltage regulator transformer assembly 302 can be, for example, a Siemens JFR series but in any event is of a conventional type which includes a multi-tap transformer 304 and an associated tap changer-(tap changing mechanism) 306. The tap changer 306 is controlled by the voltage regulator controller 308 which receives signals indicative of voltage and current in the windings of the transformer 304 and conventionally generates tap control signals in accordance with operator programmed set-points and thresholds for these signals. The voltage regulator 302 can also be provided with a non-volatile memory (personality module) 310 which stores statistics and historical information relating to the voltage regulator.

The voltage regulator controller 308 includes a processor section (processor board) 312, a high voltage interface 314, a PCMCIA memory card interface 315 (for receiving a conventional PCMCIA standard memory card 316), an I/O expansion chassis (rack) 317 which is coupled to the processor section 312 by way of a bus 318 and a front panel 320 which is coupled to the processor section.

The front panel 320 provides an operator interface including a keypad 322, a character display 324, indicators 326 for various regulator conditions and a serial communications port connector 328. A user interface task (usint) 330 running under the processor section's main control program (mcp) 332 monitors activity on the keypad 322 and provides responses to the character display 324 as needed. The front panel 320, its associated operator interface and the user interface task 330 can be of the type described in U.S. patent application Ser. No. 07/950,402; filed on Sep. 23, 1992, which is incorporated by reference in its entirety as if printed in full below.

The processor section 312 generates digital control signals based on internal program code and operator selected parameters entered (by an operator) via the controllers front panel 320. The processor section 312 is controlled by a microprocessor (μP) 334. The microprocessor 334 is coupled to a serial electrically erasable read only programmable memory (EEPROM) 336 which stores the operations count and operator programmed configuration data including "control program selection parameters".

In operation, high voltage signals are generated by the voltage regulator transformer 304. The high voltage interface 314, in turn, further scales the transformed down signals for reading by an analog to digital converter (shown in FIG. 4) within the processor section 312. The data fed back from the voltage regulator 302 is used by the processor section 312 to make tap change control decisions and to provide indication of various conditions to an operator.

The processor board monitors tap changes by sensing an "Operations Counter" signal from the transformer assembly 304. The Operations Counter signal is generated by an electronic switch 338 (FIG. 5) located on the tap changer mechanism 306. Each time the tap position changes, the switch is toggled from one position to the other. If the switch is open before the tap change, it closes as the tap change occurs; and vice-versa.

In accordance with the present invention, the processor section stores a plurality of tap control programs A–E in its non-volatile memory as well as a default control program. At any given time, only one of the tap control programs is active (i.e. controls changes in the tap position). Which control program is active depends on how the regulator's operating conditions compare to the operator programmed selection parameters.

Another program task, the "switching task" 340 periodically (e.g. once a second) monitors the regulator's operating conditions and causes the mcp to activate (use as the sole executing tap control program) the appropriate control program (A-E or default) for the set of conditions that is occurring at the monitoring time.

Examples of the stimuli (particular operating conditions) that can be monitored is shown in Table 1. For each stimuli, a different tap control program operating in accordance with a different control algorithm is selected as being "active". When more than one of the stimuli occurs simultaneously, the active tap control program is chosen in accordance with a priority scheme as shown in table 1, where 1 is the highest priority and 5 is the lowest priority.

TABLE 1

| STIMULUS | PRIORITY | ACTIVE CONTROL PROGRAM |
|---|---|---|
| Demand/ Metering Values | 2 | A |
| Time/Date | 5 | B |
| External Input | 3 | C |
| Serial Port Command | 4 | D |
| Fault/Maintenance Status | 1 | E |

Figure 1:
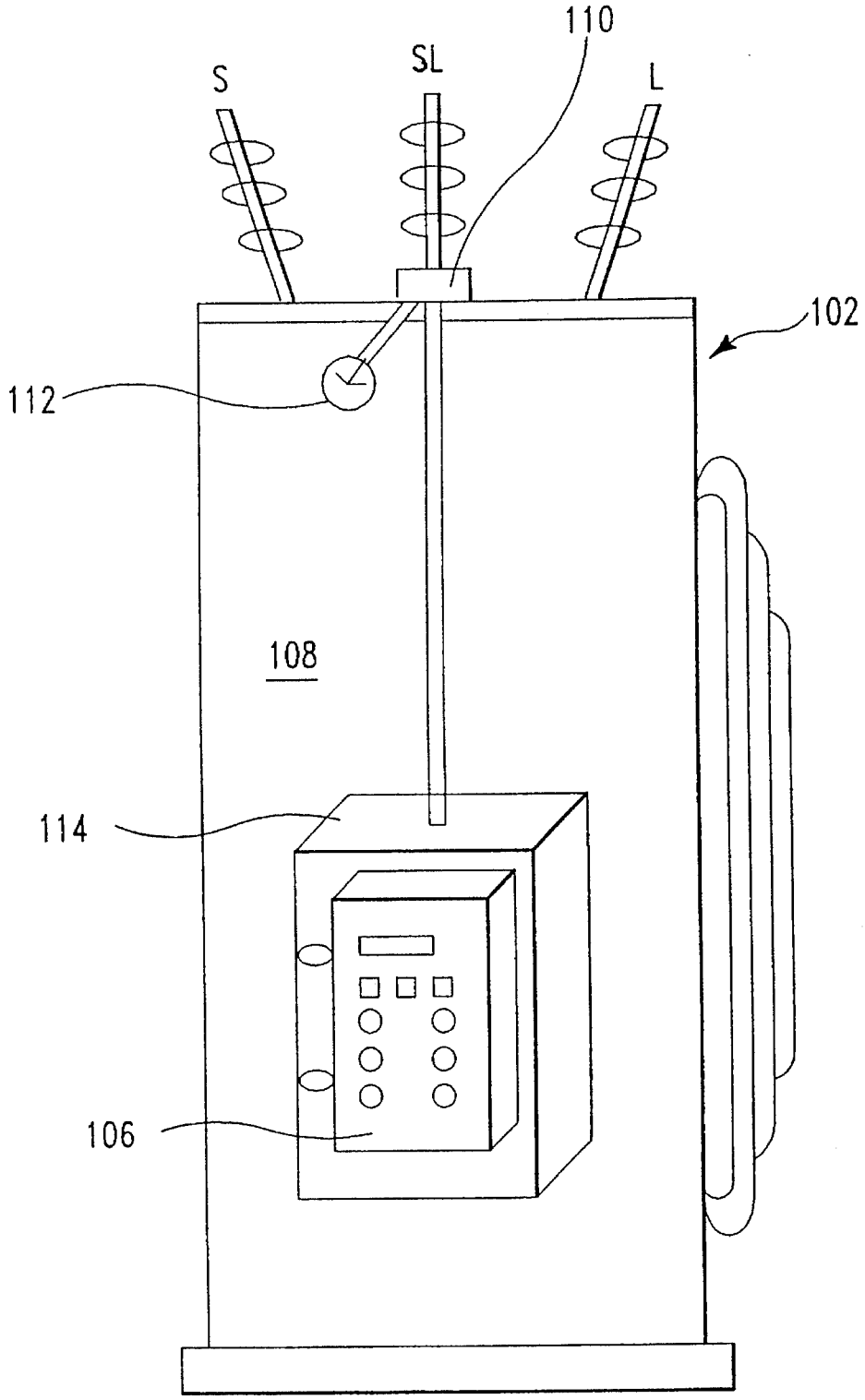
(PRIOR ART) FIG. 1
FIG. 1 shows a conventional voltage regulator transformer assembly and controller.

When the operator selects multiple control mode (by way of the from panel and keypad) the processor section displays a list of operator selectable stimuli (such as shown in FIG. 1) on the display. For each of the stimuli selected, the operator is first prompted to identify the particular control program which will be associated with occurrence of the stimuli. Once the control program is identified, the operator is presented with a submenu of configuration settings. Optionally, the operator can also be prompted to select the priority for the selected stimuli although in the presently described embodiment the stimuli are assigned preprogrammed priorities.

Those of skill in the art will recognize that the multiple tap position control algorithms need not be implemented by completely independent program tasks. As an alternative, programs A-E can modify the operation of the default control task by, for example, setting bits in a control register which cause the default task to behave differently. In such an embodiment, what the operator is actually specifying is an active control algorithm which is implemented by a combination of the default control program and control program parameters set by way of executing programs A-E. In any event, it should be understood that a change in the selection of a control program A-E represents a change in the algorithm that controls the positioning of regulator tap.

When the operator selects Demand/Metering Values, a menu of selectable metered parameters is displayed and the operator is prompted to select one of metered parameters to control the activation of program A. For example the operator can select from metered parameters including KVAR demand, Power Factor, Load Current and any other parameters monitored by the metering task. Once a metered parameter is selected, the operator is prompted to enter a range which will activate the corresponding control program. For example, where a power factor is selected, the operator also selects a power factor range (a high threshold and a low threshold) during which program A is invoked by the switching task.

When the operator selects Time/Date, a prompt is displayed requesting the operator to specify a starting and ending time and date or a periodic interval over which program C is to be activated.

When the operator selects external input, a menu of external inputs is displayed and the operator is prompted to select one or more which will trigger program C. These can include, for example, analog and discrete external inputs brought in through the I/O expansion chassis and external trigger sources.

When the operator selects serial port, the mcp commences monitoring of the serial port 328 for algorithm switching commands received by way of the port's serial communication lines.

When Fault/Maintenance Status is selected, a menu of diagnostic test results and maintenance status is displayed and the operator is prompted to select one which will cause the control program to change. Preferably, the control algorithm associated with program E will be of a type that minimizes tap control activities until the fault/maintenance issue had been resolved.

It should be understood that the active program could also be selected upon a combination of conditions. For example, the Demand/Metering Values can be enabled to change the control tasks only when the Time/Data settings are within a selected range.

Figure 6:
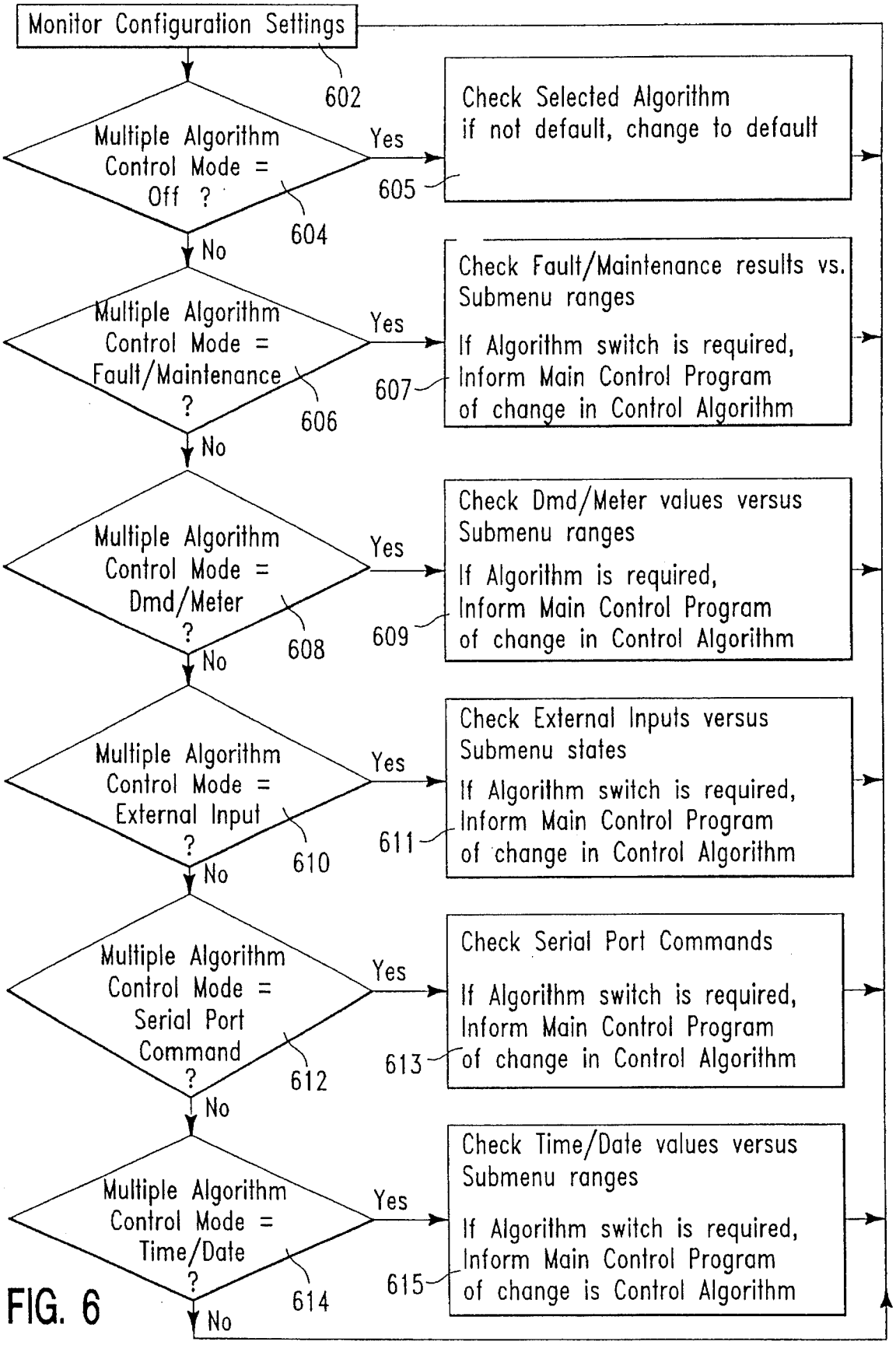
FIG. 6 is a more detailed diagram of the switching task of FIG. 3.

A flow chart of the switching task is shown in FIG. 6. The configuration settings are periodically monitored by the main control program in step 602.

In step 604 the switching task determines if multiple control algorithm (MCA) mode is "OFF". If MCA mode is "OFF", in step 605 the switching task selects the default tap control algorithm. If MCA mode is "ON" the switching task proceeds to test the particular control mode settings (in priority order) to determine which settings are selected.

In step 606 the switching task determines whether Fault/Maintenance mode has been selected. If yes, in step 607 the switching task compares the present fault/maintenance state with the operator selected state and switches the tap control program to task E if they match. Otherwise the control program remains as currently selected.

If Fault/Maintenance mode has not been selected, in step 608 the switching task determines whether Demand/Metering mode has been selected. If yes, in step 609 the switching task compares the selected metered values with the operator selected submenu ranges and, if the metered values are in range, the switching task informs the mcp to change the tap control program to task A. Otherwise, the control program remains as currently selected.

If Demand/Metering has not been selected, in step 610 the switching task determines whether External Input mode has been selected. If yes, in step 611 the switching task compares the present state of the external inputs with the operator selected external input states and switches the tap control program to task C if they match. Otherwise, the control program remains as currently selected.

If External Input mode has not been selected, in step 612 the switching task determines whether Serial Port mode has been selected. If yes, in step 613 the switching task checks for algorithm switching commands received via the serial communication(s) port(s) and switches the tap control program to task D if the serial port switching command has been received. Otherwise, the control program remains as currently selected.

If Serial Port mode has not been selected, in step 614 the switching task determines whether Time/Date mode has been selected. If yes, in step 615 the switching task compares the present time and date with the pre-set time and date or periodic interval. If the time/date is in the user selected range, the switching task informs the mcp to change the tap control program to task B. Otherwise, the control program remains as currently selected.

Figure 2:
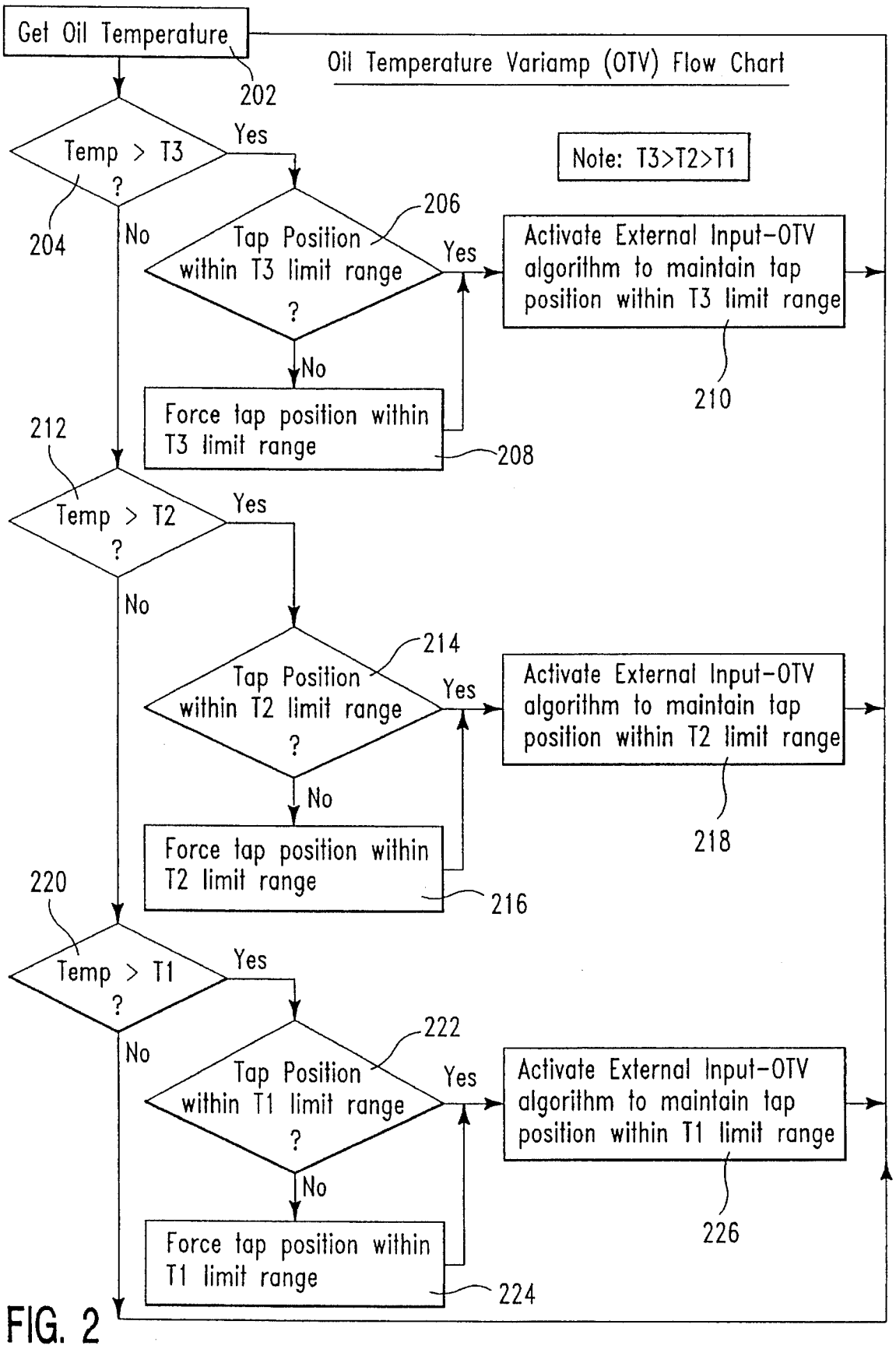
FIG. 2 is a flow chart of variamp oil temperature control according to an embodiment of the present invention.

An example of the external input algorithm operating mode is oil temperature variamp (OTV). A flow chart of the operation of this mode is shown in FIG. 2. When Oil Temperature Variamp mode is selected the processor section monitors the oil temperature by way of a transducer 350 disposed inside the oil within the transformer assembly 302. If External Input-OTV mode has been selected, in step 202 the switching task reads the oil temperature measured by the temperature transducer 350. In step 204 the oil temperature is compared against a first temperature threshold T3. If the oil temperature exceeds the first temperature threshold (e.g. 115 degrees Centigrade) in step 206 switching task compares the present tap position with a new tap position excursion range to be used when T3 has been exceeded (this range is referred to hereinafter as the "T3 range"). In the present embodiment, this range is one-quarter the full tap excursion range. If the tap position is not within T3 new range, in step 208 the processor section moves the tap position into range and then, in step 210, the switching task activates a first tap position control program which causes the regulator to run towards the neutral position (raise or lower direction) to below one-third the full range. If the present tap position is in the T3 range, step 210 is executed directly following step 206. The maximum range of the tap position excursions remains one-quarters of the full range until such time as the oil temperature drops below T3—10 degrees C.

If the oil temperature does not exceed the first temperature threshold, in step 212 the switching task compares the oil temperature to a second, lower, temperature threshold. If the oil temperature exceeds the second threshold (e.g. 105 degrees Centigrade), in step 214 switching task compares the present tap position with the new tap position excursion range to be used when T2 (but not T3) has been exceeded (this range is referred to hereinafter as the "T2 range"). In the present embodiment, this range is one-half of the full tap excursion range. If the tap position is not within the T2 range, in step 216 the processor section moves the tap position into the T2 range and then, in step 218, the switching task activates a second tap position control program which causes the regulator to run towards the neutral position (raise or lower direction) to below one-half of the full range. If the present tap position is in the T2 range, step 218 is executed directly following step 214. The maximum range of the tap position excursions remains one-half of the full range until such time as the oil temperature reaches the first threshold T3 or drops below T2—10 degrees C.

If the oil temperature does not exceed the first or second temperature thresholds (T3, T2), in step 220 the switching task compares the oil temperature to a third, lower, temperature threshold T1. If the oil temperature exceeds the third threshold (e.g. 90 degrees Centigrade), in step 222 switching task compares the present tap position with the new tap position excursion range to be used when T1 (but not T2) has been exceeded (this range is referred to hereinafter as the "T1 range"). In the present embodiment, this range is three quarters the full tap excursion range. If the tap position is not within the T1 range, in step 224 the processor section moves the tap position into the T1 range and then, in step 226, the switching task activates a third tap position control program which causes the regulator to run towards the neutral position (raise or lower direction) to below three-quarters of the full range. If the present tap position is within the T1 range, step 226 is executed directly following step 222. The maximum range of the tap position excursions remains three-quarters of the full range until such time as the oil temperature reaches the second threshold T2 or drops below T1—10 degrees C.

For example, assume settings are: T1=90° C., T2=105° C. and T3=115° C.; The current tap position is at 16 raise; and the oil temperature sensor indicates a 90° C. reading. The external Input-OTV algorithm responds by forcing tap lower operations until the tap position is below 12 raise. The algorithm then limits the tap position to between 12 lower and 12 raise. Subsequently, the oil temperature sensor reads 105° C. or higher. External Input-OTV algorithm responds by forcing tap lower operations until the tap position is below 8 raise. The algorithm then limits the tap position to between 8 lower and 8 raise. Note that if the third temperature threshold were exceeded, the External Input-OTV algorithm would force limiting of the tap position range to between 4 raise and 4 lower.

The thresholds T1, T2, T3 are operator programmable and default to preset limits (e.g. 90° C., 105° C. and 115° C. respectively) in the absence of operator programmed thresholds.

Figure 5:
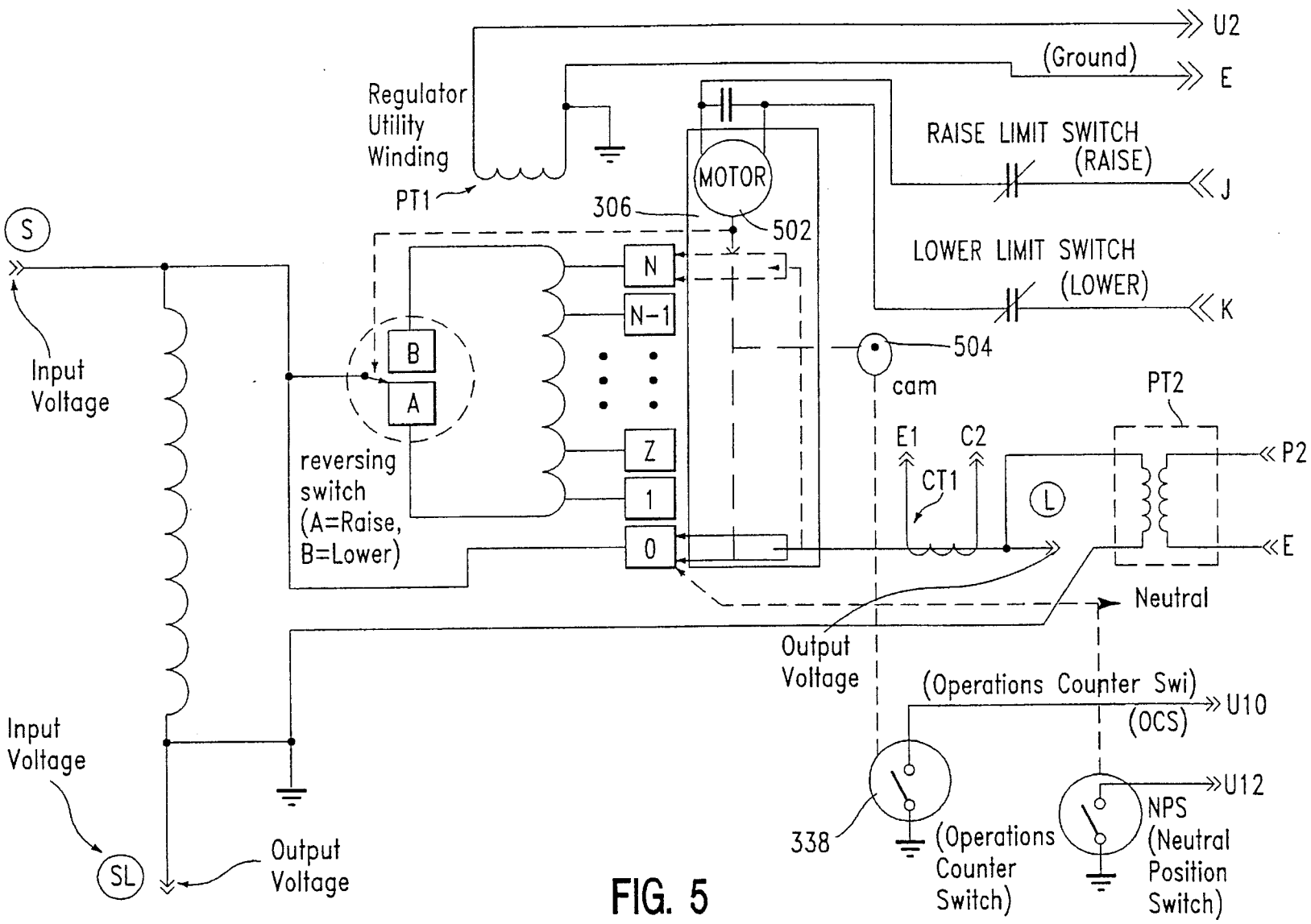

The tap changing mechanism, transformer and switch are shown in more detail in FIG. 5. The components of FIG. 5 are part of a conventional voltage regulator transformer assembly and thus, most will not be described in detail here. The tap changing mechanism 306 is operated by a stepper motor 502 which is in turn operated by way of raise (J) and lower (K) control signals. The operations counter switch 338 is operated by a cam 504 which rotates half a turn each time a tap change is made. One side of the switch 338 is connected to AC return ("E" ground). The Operations Counter signal that is input to the controller is thus alternately (1) open circuit (2) closed to ground, each time a tap change occurs.

The present invention may be embodied as an improvement to the base circuitry and programming of an existing microprocessor based voltage regulator controller. An example of a controller having suitable base circuitry and programming is the Siemens MJ-X voltage regulator controller, available from Siemens Energy and Automation, Inc. of Jackson, Miss., USA.

Figure 4:
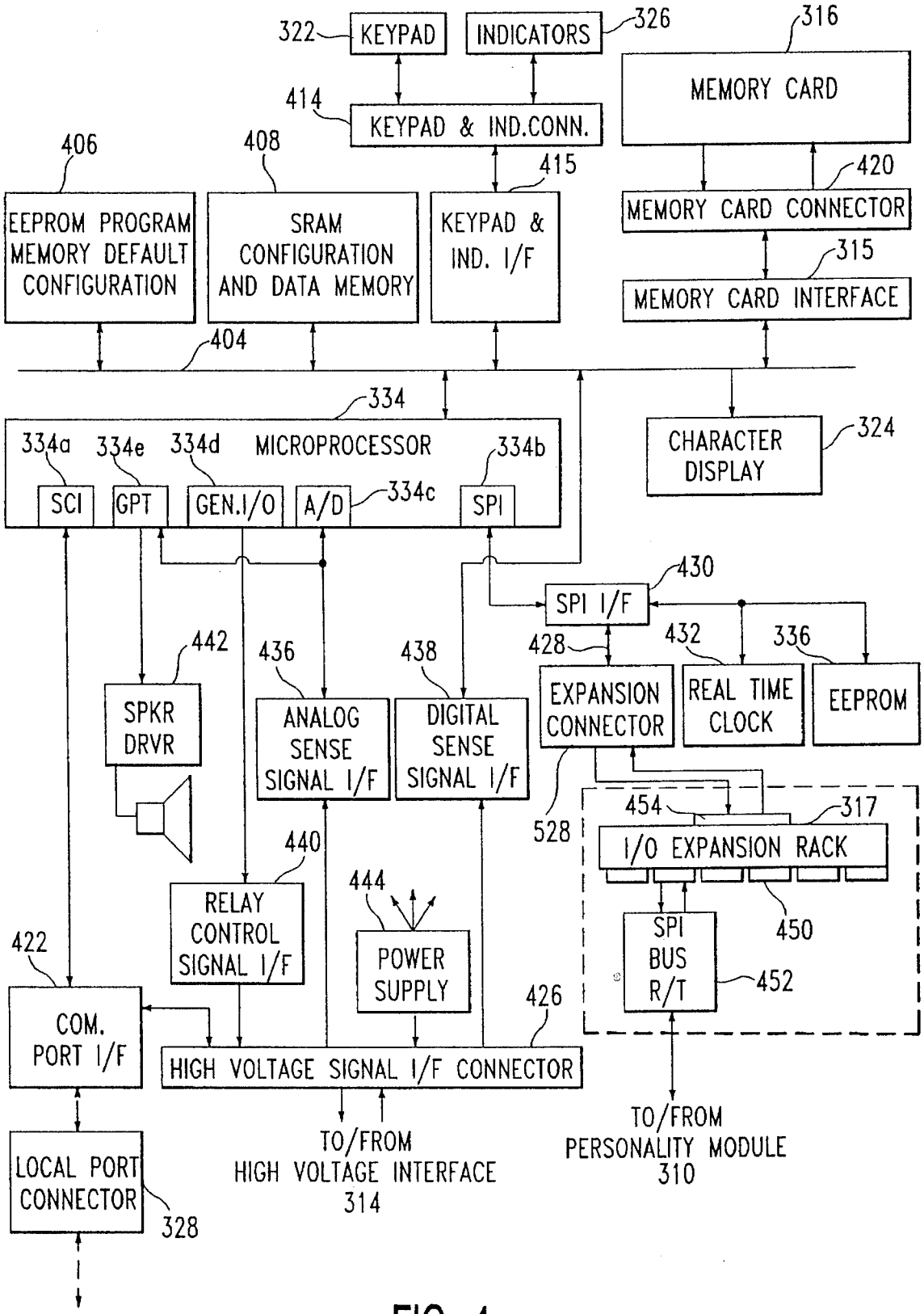
FIG. 4 is a more detailed diagram of the processor board of FIG. 3 showing its interconnection to other components of the voltage regulator controller; and, FIG. 5 is a more detailed diagram of the step-transformer, tap changing mechanism and operations counter of FIG. 3.

A more detailed block diagram of the processor section 312 and its interconnection to other elements of the voltage regulator controller is illustrated in FIG. 4.

The processor section 312 includes the microprocessor 334 (for example, a Motorola 68HC16) which is coupled to the other processor elements by way of a common bus 404. An electrically erasable programmable read only memory (EEPROM) 406 includes the microprocessor's program instructions and default configuration data.

A static type random access memory (SRAM) 408 stores operator programmed configuration data and includes areas for the microprocessor 334 to store working data and data logs.

The microprocessor 334 also communicates with the alphanumeric character display 324, the keypad 322 and indicators 326 and the memory card interface 315 via the bus 404.

The keypad 322 and indicators 326 are coupled to the bus 404 via a connector 414 and a bus interface 415. As previously described, a memory card 316 can be coupled to the bus 404 by way of a conventional PCMCIA standard interface 315 and connector 420.

Operational parameters, setpoints and special functions including metered parameters, log enables, log configuration data and local operator interfacing are accessed via the keypad 322. The keypad is preferably of the membrane type however any suitable switching device can be used. The keypad provides single keystroke access to regularly used functions, plus quick access (via a menu arrangement) to all of the remaining functions.

The microprocessor 334 includes an SCI port 334*a* which is connected to a communication port interface 422. The communication port interface 422 provides the SCI signals to the external local port 328 on the controller's front panel 320. An isolated power supply for the communication port interface 422 is provided by the high voltage interface 314 via a high voltage signal interface connector 426.

The communication port interface 422 supports transfer of data in both directions, allowing the controller to be configured via a serial link, and also provides meter and status information to a connected device. In addition to supporting the configuration and data retrieval functions required for remote access, the communication port interface 422 supports uploading and/or downloading of the program code for the microprocessor 334.

The communication port interface 422 can be, for example, an RS-232 compatible port. The local port connector 328 can be used for serial communication with other apparatus, for example a palmtop or other computer. The physical interface of the local port connectors 328 can be a conventional 9-pin D-type connector whose pin-out meets any suitable industry standard.

The microprocessor 334 also includes a SPI port 334*b* which is connected to an expansion connector 428 by way of an SPI interface 430. The expansion connector brings the SPI bus 318 out to the I/O expansion chassis 317 via a cable. Other devices that reside on the SPI bus include a real time clock 432 and the serial EEPROM 336. The real time clock can be used to provide the time and date and data indicative of the passage of programmed time intervals. The serial EEPROM 336 stores operator programmed configuration data, the look-up tables 336*a*, 336*b* and the operations count. The operator programmed configuration data is downloaded to the SRAM 408 by the microprocessor 334 when the processor section 312 is initialized. The SRAM copy is used, by the microprocessor, as the working copy of the configuration data. The real time clock 432 is programmed and read by the microprocessor 334.

The high voltage signal interface connector 426 provides a mating connection with a connector on the high voltage interface 314. Scaled analog signals from the high voltage interface 314 (including scaled versions of I, Vin and Vout) are provided to an A/D converter port 334*c* by way of an analog sense signal interface 436. The analog sense signal interface 436 low pass filters the scaled analog input signals prior to their provision to the A/D converter port 334*c*. Digital signals from the high voltage interface 314 are provided to the bus 404 via a digital sense signal interface 438. The digital sense signal interface 438 provides the proper timing, control and electrical signal levels for the data.

Control signals from the microprocessor's general I/O port 334*d* are provided to the high voltage signal interface connector 426 by way of a relay control signal interface 440. The relay control signal interface converts the voltage levels of the I/O control signals to those used by the high voltage interface 314. A speaker driver 442 is connected to the GPT port 334*e* of the microprocessor 334. The processor section 312 also includes a power supply 444 which provides regulated power to each of the circuit elements of the processor section 312 as needed. The high voltage interface 314 provides an unregulated power supply and the main 5 volt power supply for the processor section 312.

The microprocessor 334 recognizes that a memory card 316 has been plugged into the memory card interface 315 by monitoring the bus 404 for a signal so indicating. In response, the microprocessor 334 reads operator selected control parameters entered via the controller's keypad 322. Depending on the control parameters, the microprocessor either updates the programming code in its configuration EEPROM 406, executes the code from the memory card 316 while it is present but does not update its EEPROM 506, or dumps selected status information to the memory card 316 so that it can be analyzed at a different location. As an alternative embodiment, the processor section 312 can be programmed to default to the memory card program when the presence of a memory card is detected. In this case, upon detection, the program code from the memory card would be downloaded to the SRAM 408 and executed by the microprocessor from there.

The I/O expansion chassis (rack) 317 includes a number (e.g. 6) of connectors 450 for receiving field installable, plug-in I/O modules 452. The connectors 450 are electrically connected to the SPI bus 318 via a common processor section interface connector 454 and couple the I/O module(s) 452 to the SPI bus 318 when they are plugged into the chassis.

The processor section 312 can communicate with the personality module 310 by way of an I/O module (SPI BUS R/T) in the I/O expansion chassis. An SPI R/T or other communications port can also be used to provide outside access to the controller's data logs and configuration parameters otherwise accessible on the front panel. The external stimuli and serial port commands used to change the tap control algorithm can also be input to the processor board by way of I/O modules (e.g. a serial communications controller for the serial communications commands or a digital and/or analog input module for the external stimuli).

Now that the invention has been described by way of the preferred embodiment, various modifications, enhancements and improvements which do not depart from the scope and spirit of the invention will become apparent to those of skill in the art. Thus, it should be understood that the preferred embodiment has been provided by way of example and not by way of limitation. The scope of the invention is defined by the appended claims.

We claim:

1. A voltage regulator controller for use with a multi-tap voltage regulator transformer having a plurality of tap positions for adjusting an output voltage in discrete tap position steps, comprising:

a memory having a tap movement control code stored therein for controlling the tap positions in accordance with a plurality of tap position control algorithms;

an operator interface for receiving configuration parameters from an operator; and, selections controls, connected to receive the configuration parameters and connected to monitor oil temperature within the transformer, for selecting one of the tap position control algorithms as being active as a function of the configuration parameters and the oil temperature.

2. The voltage regulator controller of claim 1 wherein the configuration parameters comprise at least one temperature threshold and wherein the tap position control algorithms have different full scale ranges for tap position excursions made by the transformer.

3. The voltage regulator controller of claim 1 wherein the configuration parameters include a plurality of temperature threshold, wherein the tap position control algorithms have a hierarchically different full scale ranges for tap position excursions made by the transformer.

4. The voltage regulator controller of claim 3 wherein the temperature thresholds default to 90 degrees centigrade and 105 degrees centigrade in the absence of operator selection.

5. The voltage regulator controller of claim 3 wherein the full scale ranges for the thresholds are ¾ full scale and ½ full scale, respectively.

6. The voltage regulator controller of claim 3 wherein the temperature thresholds default to 90 degrees centigrade, 105 degrees centigrade and 115 degrees centigrade in the absence of operator selection.

7. The voltage regulator controller of claim 3 wherein the full scale ranges for the thresholds are ¾ full scale and ½ full scale, and ¼ full scale respectively.

8. A voltage regulator controller for use with a multi-tap voltage regulator transformer having a plurality of tap positions for adjusting an output voltage in discrete tap position steps, comprising: a memory having tap movement control code stored therein for controlling the tap positions in accordance with a plurality of tap position control algorithms, a temperature transducer for measuring the oil temperature of the voltage regulator transformer, logic for monitoring the oil temperature within the transformer and, logic for selecting one of the tap position control algorithms as being active as a function of the oil temperature.

* * * * *